US006367537B1

(12) United States Patent
Hsu

(10) Patent No.: US 6,367,537 B1
(45) Date of Patent: Apr. 9, 2002

(54) ROLL-UP TYPE VENETIAN BLIND

(75) Inventor: Pey-Son Hsu, Changhua Hsien (TW)

(73) Assignee: Ching Feng Blinds Ind. Co., Ltd., Changhua Hsien (TW)

( * ) Notice: Subject to any disclaimer, the term of this patent is extended or adjusted under 35 U.S.C. 154(b) by 0 days.

(21) Appl. No.: 09/755,034

(22) Filed: Jan. 8, 2001

(51) Int. Cl.[7] ..... A47G 5/02
(52) U.S. Cl. ..... 160/243
(58) Field of Search ..... 160/243, 235, 160/232, 133

(56) References Cited

U.S. PATENT DOCUMENTS

| | | | | | |
|---|---|---|---|---|---|
| 2,808,222 | A | * | 10/1957 | Wassyng et al. | 160/133 X |
| 3,173,475 | A | * | 3/1965 | Wegner | 160/235 X |
| 4,343,340 | A | * | 8/1982 | Paule | 160/232 |
| 4,603,725 | A | * | 8/1986 | Knight | 160/243 |
| 4,955,421 | A | * | 9/1990 | Torti | 160/243 |

* cited by examiner

*Primary Examiner*—David M. Purol
(74) *Attorney, Agent, or Firm*—Troxell Law Office PLLC

(57) ABSTRACT

An improved roll-up type Venetian blind is made up of an upper bracket and a plurality of roll-up slats. The upper bracket has a C-shaped receiving groove opened up downward and has a pair of cord passage holes at the left end and the right end respectively thereof. An adjustment unit is disposed on a front side wall of the left end of the upper bracket. Each roll-up slat is made up of a pair of flexible hook connectors that are reversely and integrally bound together to form a hollow chamber therebetween for ventilation. A number of partition plates are horizontally placed in the hollow chamber. Each hook connector has an upper pivot hook end and a lower pivot hook end. The upper pivot hook end is smaller than the receiving groove but is larger than the opening of the receiving groove whereby the assembly of the Venetian blind becomes ready and fast, saving time and labor in one aspect and the dissipation of heat of the Venetian blind is greatly advanced in another aspect.

1 Claim, 3 Drawing Sheets

ROLL-UP TYPE VENETIAN BLIND

BACKGROUND OF THE INVENTION

The present invention relates to an improved roll-up type Venetian blind which is made up of an upper bracket and a plurality of roll-up slats. The upper bracket has a C-shaped receiving groove opened up downward and has a pair of cord passage holes at the left end and the right end respectively thereof. An adjustment unit is disposed on a front side wall of the left end of the upper bracket. Each roll-up slat is made up of a pair of flexible hook-shaped connectors that are reversely and integrally bound together to form a hollow chamber therebetween for ventilation. A number of partition plates are horizontally placed in the hollow chamber Each hook-shaped connector has an upper pivot hook end and a lower pivot hook end. The upper pivot hook end is smaller than the receiving groove but is larger than the opening of the receiving groove whereby the assembly of the Venetian blind becomes ready and fast so as to save time and labor in one aspect and the dissipation of heat of the Venetian blind is greatly advanced.

Referring to FIG. 1, a conventional roll-up type Venetian blind has an upper suspension rod 10 to which are attached a plurality of tubular slats 20 connected to one another by way of cords 11 to form a roll-up type slats structure of proper length. At both ends of the suspension rod 10 is disposed a cord passage hole 12 for the passage of a pull cord 13 which is engaged with the bottommost slat 20 so that the pull cord 13 can be pulled to roll up, as shown in FIG. 2. The pull cord 13 is located in an adjustment device 14 and can be used to vary the height of the blind and fix the blind in place by the adjustment device when pulled in operation.

To roll up the blind 1, the pull cord 13 is first pulled aside to release the adjustment device 14 and then the pull cord 13 is pulled downward with force. As a result of the pulling, the bottommost tubular slat 20 is forced to move upwardly and the other slats are pushed to roll up into a bundle as shown in FIG. 2 by the pull cord 13. Once the blind is pulled up to a certain position, the pull cord 13 is released and retained in place by the adjustment device 14. To lower the blind, the pull cord 13 is first pulled aside to disengage the pull cord 13 from the adjustment device 14, and then the pull cord 13 is release to withdraw upward so as to permit the blind to drop down. To fix the blind in position, the pull cord 13 is again pulled aside to make the adjustment device retain the pull cord 13 in place.

There are a number of disadvantages associated with such a prior slat structure:

1. Such a roll-up slats 20 are all connected to one another with cords 11 by manual labor to form a roll-up Venetian blind, resulting in waste of time and labor.
2. The tubular slats 20 are not closely connected to one another with a crevice unavoidably formed between every two slats, resulting in sun light easily cast into room via the crevices.
3. The tubular slats are joined together by thin threads 11 which are easily broken and the repair or replacement of tubular slats 20 becomes too tedious and time consuming. The broken blind is often discarded as a waste.

SUMMARY OF THE INVENTION

Therefore, the primary object of the present invention is to provide an improved slat structure for use in a Venetian blind. The slats are snapped into engagement with one another end to end in an easy and speedy manner so as to make the assembly fast and ready, resulting in the saving of labor and time and reduction of production cost.

Another object of the present invention is to provide an improved slat structure for a roll-up type Venetian blind. The slats thereof are pivotally connected to one another to form a closely connected Venetian blind with no crevices produced between the slats so that no sunlight beam can penetrate therethrough, resulting in better light sheltering and heat dissipating.

One further object of the present invention is to provide an improved slat structure whose slats are pivotally connected to one another in such a manner that one broken piece of the slats can be readily and quickly replaced. Thereby people can save a lot of money on maintaining Venetian blinds.

DETAILED DESCRIPTION OF THE PREFERRED EMBODIMENT

Figure 3:
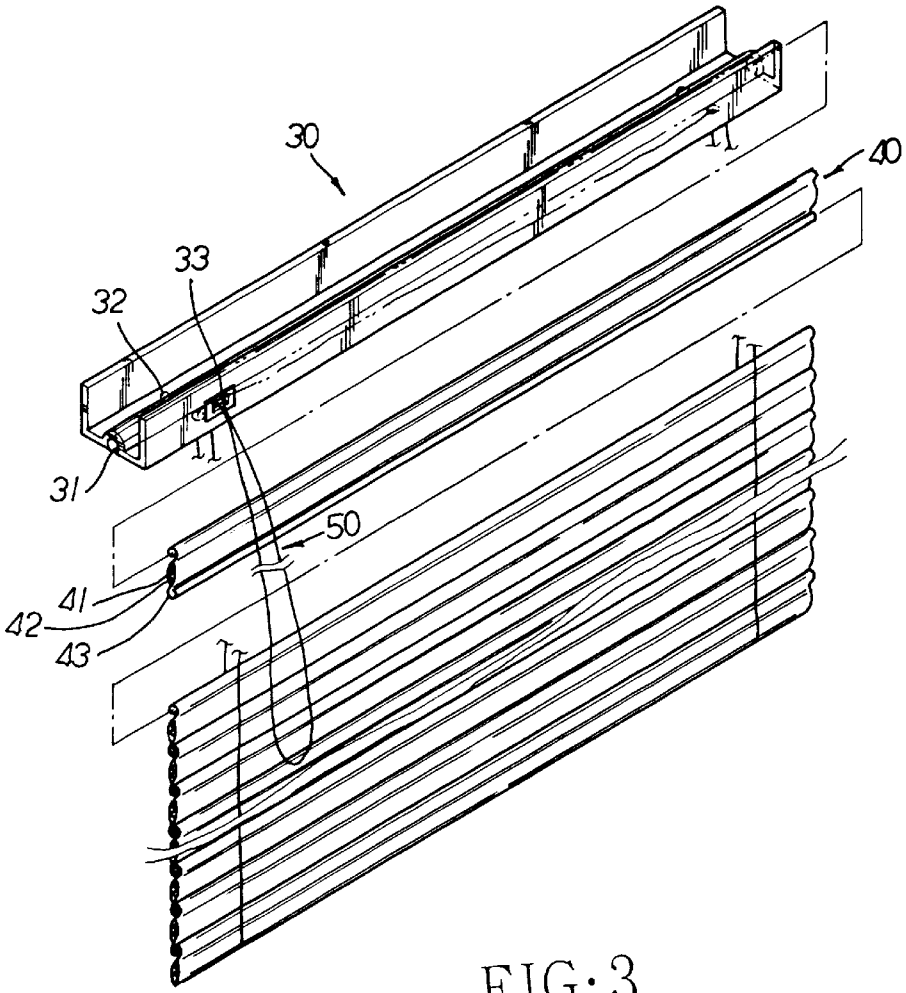
FIG. 3 is a perspective diagram showing the partially exploded roll-up type Venetian blind of the present invention.

Referring to FIG. 3, the roll-up type Venetian blind of the present invention mainly comprises an upper bracket 30 and a plurality of rollable slats 40. The upper bracket 30 has an open-topped tube of a square section. At the underside of the bottom of the bracket 30 is disposed a C-shaped receiving groove 31 which has its opening facing externally and is used for engagement with the rollable slat 40. At each end of the bracket 30 are disposed a pair of cord passing holes 32 positioned at each side of the C-shaped receiving groove 31 so as to permit the pull cords 50 to be led therethrough. At the vertical front side wall of the upper bracket 30 is disposed an adjustment means 33.

Figure 4:
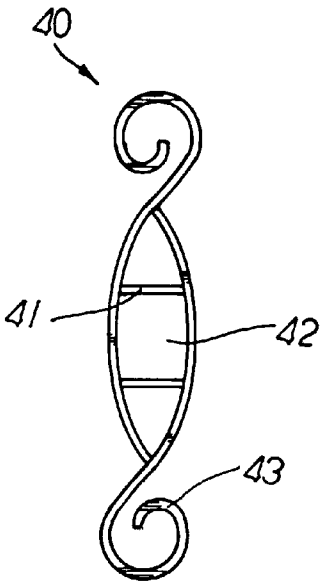
FIG. 4 is an enlarged diagram showing the slat structure of the present invention.
Figure 5:
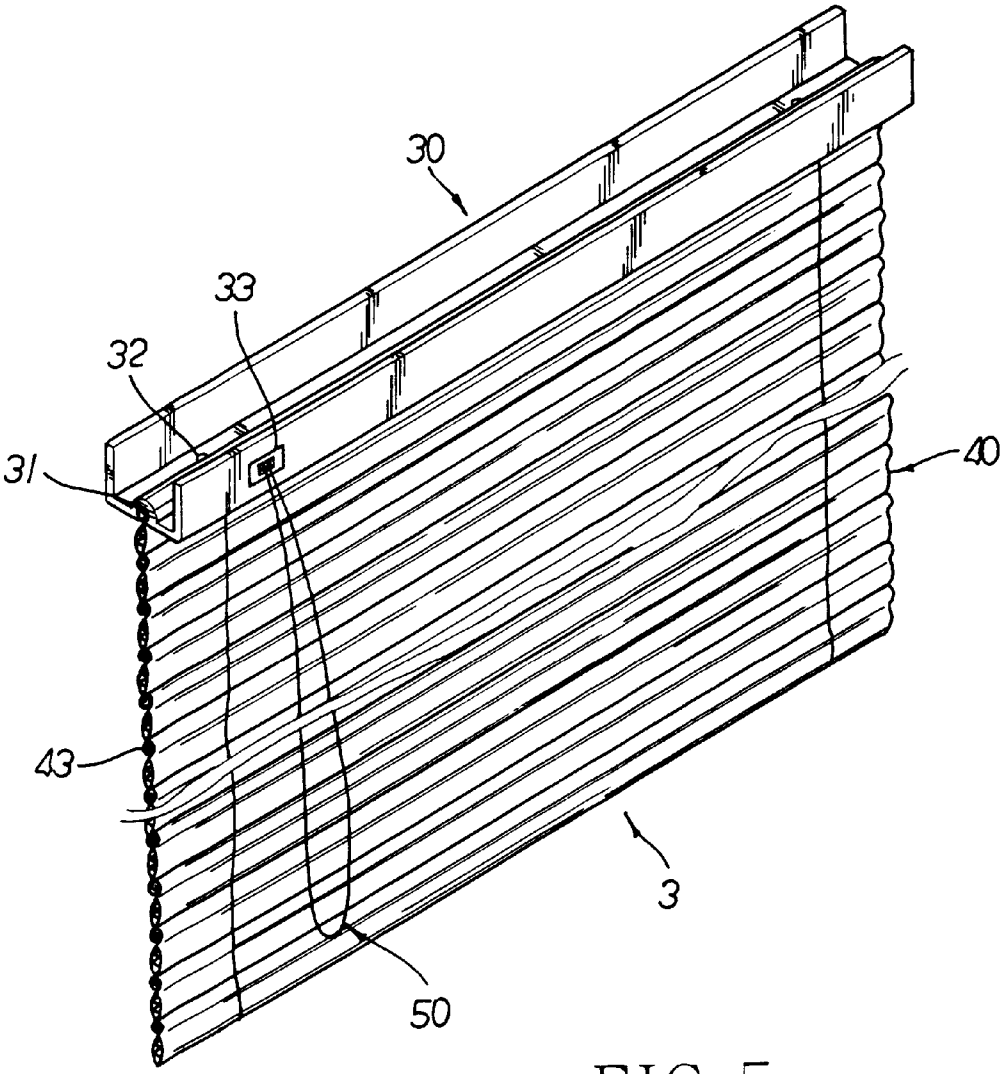
FIG. 5 is a perspective diagram showing the assembly of the present invention.

Each slat 40 is a flexible hollow structure and is made up of a pair of hook connectors 43 that are reversely coupled to each other end to end in such a manner that a hollow space 42 is formed therebetween with a pair of partition boards 41 parallelly disposed therein, as shown in FIG. 4. Thereby ventilation passages can be formed in the hollow space 42. The bottommost slat 40 can be made in such a manner that a hook connector 43 is not provided with a hook end. The hook end of the topmost slat 40 is larger than the opening of the C-shaped receiving groove 31 so that the hook connector 43 is snapped into engagement with the receiving groove 31 firmly.

To get the Venetian blind of the present invention assembled, the upper top slat 40 is hooked up to the upper bracket 30 by snapping the hook connector 43 into engagement with the C-shaped groove 31 defined at the underside thereof The hook end of the connector 43 is larger than the opening of the groove 31, so the slat 40 is not easily disengaged from the upper bracket 30. Next a second slat 40 is connected end to end to the bottom of the top slat 40 by the hook connector 43. in the same manner a plurality of identical slats 40 are coupled to one another one by one to form a Venetian blind 3. After the pivotal connection of all the slats 40 end to end to one another, the pull cord 50 is led through the cord passing holes 32 of the upper bracket 30 and wound around the sides of the bottommost slats 40. Such arranged pull cord 50 is engaged with the adjustment means 33 at the top and exposed to the upper bracket 30 which is secured to a window, wall or a ceiling to complete the assembly.

Figure 2:
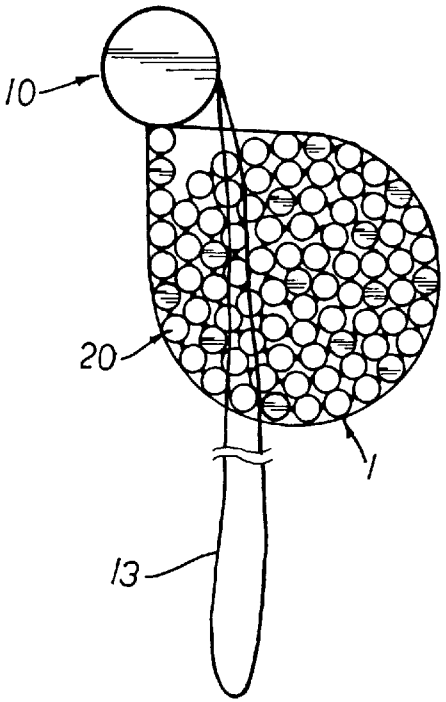
FIG·2 PRIOR ART
FIG. 2 is a side view of the prior roll-up type Venetian blind of FIG. 1.
Figure 1:
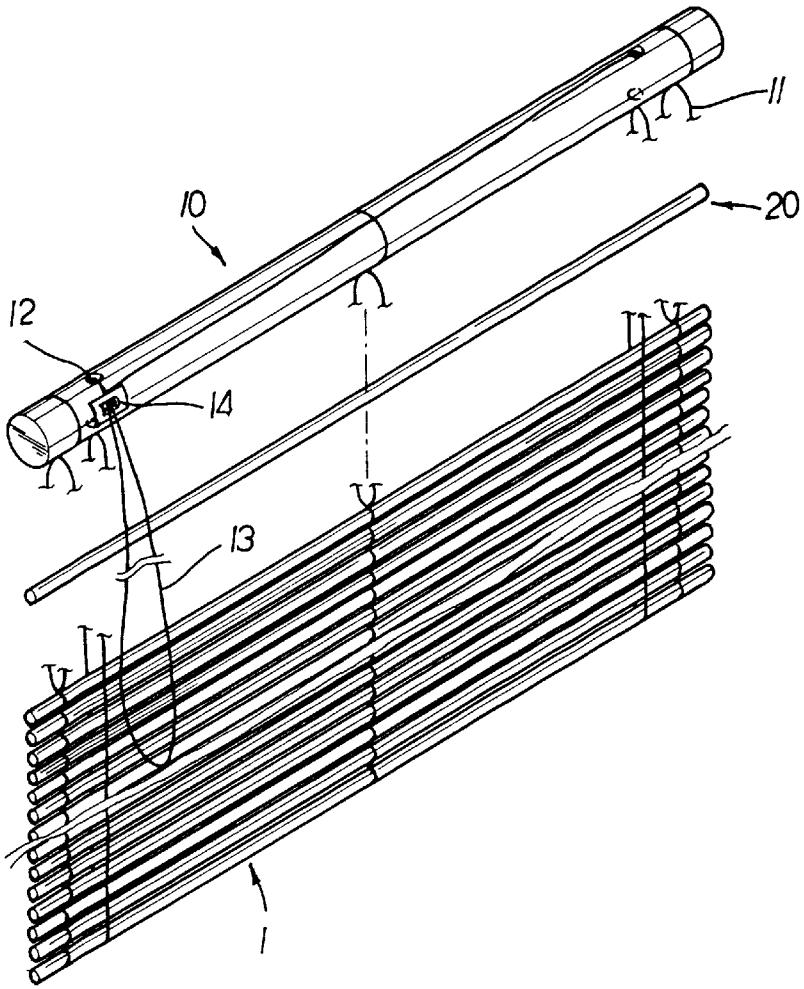
FIG·1 PRIOR ART
FIG. 1 is a perspective diagram showing a prior roll-up type Venetian blind.
Figure 6:
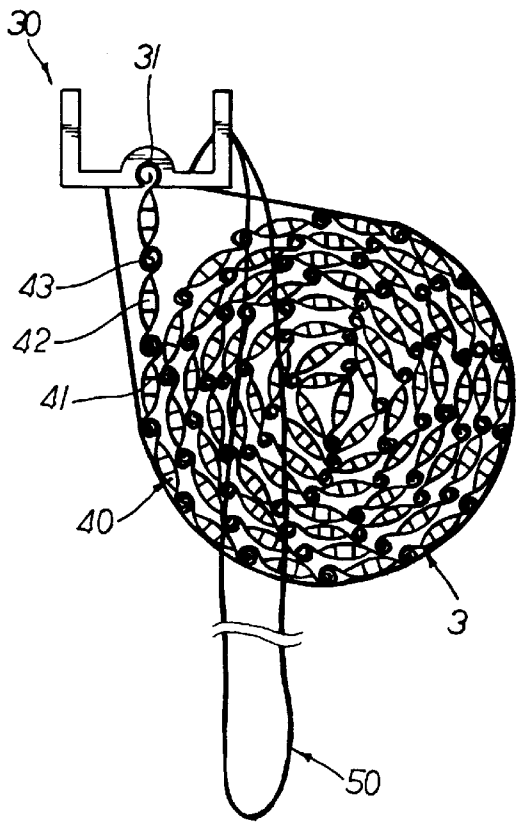
FIG. 6 is a side view showing the operation of the present invention.

When the Venetian blind 3 is to be rolled up, as shown in FIG. 6, the pull cord 50 is pulled aside so as to released the pull cord from the retaining engagement with the adjustment means 33 and then is pulled with force downwardly. As a result of the downward pulling of the pull cord 50, the bottommost slat along with the connected slats 40 is forced to roll up one by one to a selective height. As the blind 3 is placed at a particular position, the pull cord 50 is pulled aside again to make the pull cord 50 come into retaining engagement with the adjustment means 33, causing the Venetian blind to be held in place. To let the blind drop down, the pull cord 50 is first pulled aside and then is frictionally released to permit the slats to extendedly move down.

The slat structure of the present invention has the following advantages:

1. The assembly of the rollable slats 40 together is time and labor saving so as to make the production thereof competitive.
2. The slats 40 are pivotally connected to one another, leaving no crevice between two slats so that no sunlight beam can penetrate via the slats.
3. The slats 40 are in pivotal engagement with one another and can be easily separated from one another so that damaged slats are replaced with speed, saving household budget.

I claim:

1. A roll-up type Venetian blind comprising; an upper bracket and a plurality of rollable slats; said upper bracket having a pair of cord passage holes at each side thereof; an adjustment means is disposed on a front side wall of said upper bracket;

wherein said upper bracket is an open-topped tube of a square section; at an underside of a bottom of said upper bracket is disposed a C-shaped receiving groove having an opening and engageable with the rollable slat;

each of the plurality of slats is a flexible hollow structure having a pair of hook connectors, each having a hook end, and coupled to each other in such a manner that a hollow space is formed therebetween with a pair of partition boards parallelly disposed therein to form ventilation passages in said hollow space; the hook end of a topmost slat is larger than the opening of said C-shaped receiving groove so that said hook connector is snapped into engagement with the receiving groove and a plurality of identical slats are coupled to one another by the hook ends to form a Venetian blind; said adjustment means includes a pull cord through the cord passage holes of said upper bracket and wound around the sides of bottommost slats.

* * * * *